US006520367B1

(12) United States Patent
Piroch

(10) Patent No.: US 6,520,367 B1
(45) Date of Patent: Feb. 18, 2003

(54) ARTICLE DISPENSING CONTAINER

(76) Inventor: Vlastimil Piroch, 2225 West 8th Avenue, #115, Vancouver, BC (CA), V6K 2A6

( * ) Notice: Subject to any disclaimer, the term of this patent is extended or adjusted under 35 U.S.C. 154(b) by 64 days.

(21) Appl. No.: 09/648,240

(22) Filed: Aug. 25, 2000

(51) Int. Cl.[7] ..... B65D 25/24; B65D 43/16; B65D 43/22

(52) U.S. Cl. ..... 220/483; 220/4.21; 220/481; 220/830

(58) Field of Search ..... 220/483, 4.22, 220/476, 3.9, 480, 481, 827, 828, 829, 830

(56) References Cited

U.S. PATENT DOCUMENTS

| | | | | | |
|---|---|---|---|---|---|
| 2,152,174 | A | | 3/1939 | Brunetti | |
| 2,557,048 | A | * | 6/1951 | Haase | 220/830 |
| 2,717,717 | A | * | 9/1955 | Busch | 220/483 |
| 3,556,341 | A | * | 1/1971 | Rains | 220/483 |
| D325,048 | S | | 3/1992 | Penner | |
| 5,123,551 | A | | 6/1992 | King | |
| 5,170,907 | A | * | 12/1992 | Sakai | 220/481 |
| 5,316,178 | A | * | 5/1994 | Garber, Jr. | 220/481 |
| 5,405,004 | A | | 4/1995 | Vest et al. | |
| 5,490,607 | A | * | 2/1996 | Hsieh et al. | 220/483 |
| 5,645,203 | A | | 7/1997 | Tappenden | |
| 5,727,696 | A | | 3/1998 | Valiulis | |
| 5,850,957 | A | * | 12/1998 | Morris | 220/481 |
| 5,870,969 | A | * | 2/1999 | Boyce | 220/481 |
| 6,065,728 | A | * | 5/2000 | Spradlin | 220/480 |

* cited by examiner

*Primary Examiner*—Lee Young
*Assistant Examiner*—Niki M. Eloshway

(57) ABSTRACT

A article dispensing container for dispensing articles from a container that protects the articles prior to dispensing and is easily and conveniently mountable on a vertical support. The article dispensing container includes a dispensing container for dispensing articles, the receptacle comprises a lower portion which has a cavity and an upper opening, and an upper lid portion which is pivotally coupled to the lower portion adjacent to the upper opening of the receptacle.

11 Claims, 3 Drawing Sheets

ARTICLE DISPENSING CONTAINER

BACKGROUND OF THE INVENTION

1. Field of the Invention

The present invention relates to containers and more particularly pertains to a new article dispensing container for dispensing articles from a container that protects the articles prior to dispensing and is easily and conveniently mountable on a vertical support.

2. Description of the Prior Art

The use of containers is known in the prior art. More specifically, containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,645,203; U.S. Pat. No. 5,727,696; U.S. Pat. No. 5,123,551; U.S. Pat. No. 5,405,004; U.S. Pat. No. Des. 325,048; and U.S. Pat. No. 2,152,174.

While these devices fulfill their respective, particular objectives and requirements, the aforementioned patents do not disclose a new article dispensing container. The inventive device includes a dispensing container for dispensing articles, the receptacle comprises a lower portion which has a cavity and an upper opening, and an upper lid portion which is pivotally coupled to the lower portion adjacent to the upper opening of the receptacle.

In these respects, the article dispensing container according to the present invention substantially departs from the conventional concepts and designs of the prior art, and in so doing provides an apparatus primarily developed for the purpose of dispensing articles from a container that protects the articles prior to dispensing and is easily and conveniently mountable on a vertical support.

SUMMARY OF THE INVENTION

In view of the foregoing disadvantages inherent in the known types of containers now present in the prior art, the present invention provides a new article dispensing container construction wherein the same can be utilized for dispensing articles from a container that protects the articles prior to dispensing and is easily and conveniently mountable on a vertical support.

The general purpose of the present invention, which will be described subsequently in greater detail, is to provide a new article dispensing container apparatus and method which has many of the advantages of the containers mentioned heretofore and many novel features that result in a new article dispensing container which is not anticipated, rendered obvious, suggested, or even implied by any of the prior art containers, either alone or in any combination thereof.

To attain this, the present invention generally comprises a dispensing container for dispensing articles, the receptacle comprises a lower portion which has a cavity and an upper opening, and an upper lid portion which is pivotally coupled to the lower portion adjacent to the upper opening of the receptacle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new article dispensing container apparatus and method which has many of the advantages of the containers mentioned heretofore and many novel features that result in a new article dispensing container which is not anticipated, rendered obvious, suggested, or even implied by any of the prior art containers, either alone or in any combination thereof.

It is another object of the present invention to provide a new article dispensing container which may be easily and efficiently manufactured and marketed.

It is a further object of the present invention to provide a new article dispensing container which is of a durable and reliable construction.

An even further object of the present invention is to provide a new article dispensing container which is susceptible of a low cost of manufacture with regard to both materials and labor, and which accordingly is then susceptible of low prices of sale to the consuming public, thereby making such article dispensing container economically available to the buying public.

Still yet another object of the present invention is to provide a new article dispensing container which provides in the apparatuses and methods of the prior art some of the advantages thereof, while simultaneously overcoming some of the disadvantages normally associated therewith.

Still another object of the present invention is to provide a new article dispensing container for dispensing articles from a container that protects the articles prior to dispensing and is easily and conveniently mountable on a vertical support.

Yet another object of the present invention is to provide a new article dispensing container which includes a dispensing container for dispensing articles, the receptacle comprises a lower portion which has a cavity and an upper opening, and an upper lid portion which is pivotally coupled to the lower portion adjacent to the upper opening of the receptacle.

Still yet another object of the present invention is to provide a new article dispensing container that has a hinged lid that would create a weather tight seal when closed.

Even still another object of the present invention is to provide a new article dispensing container that has a spring loaded top to prevent the lid from being left open.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
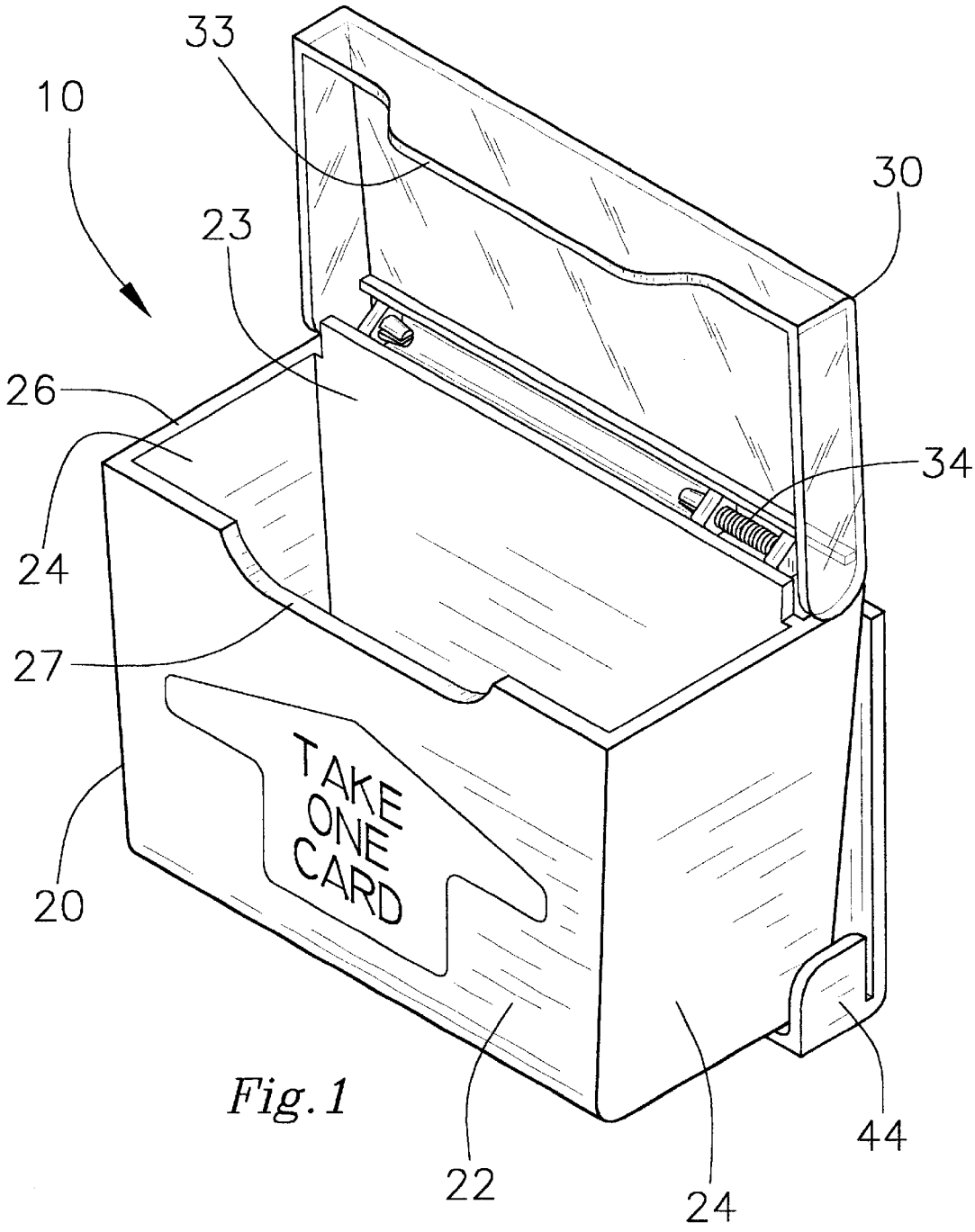
FIG. 1 is a schematic perspective view of a new article dispensing container according to the present invention.
Figure 2:
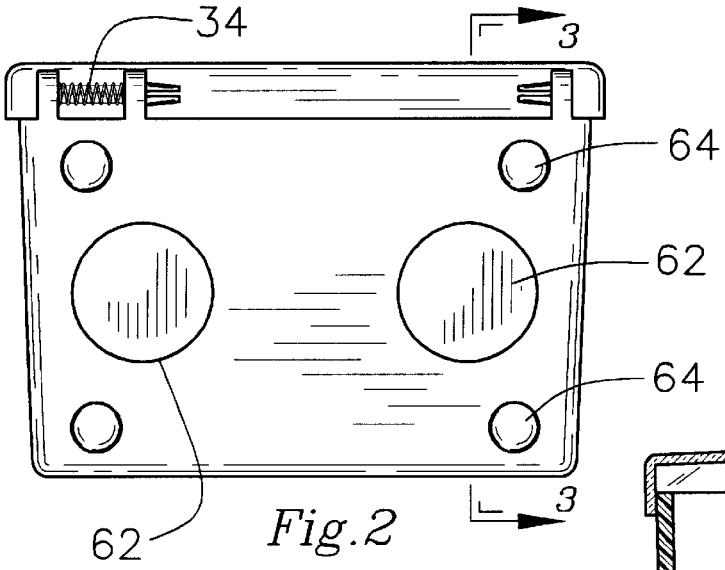
FIG. 2 is a schematic rear view of the present invention.
Figure 3:
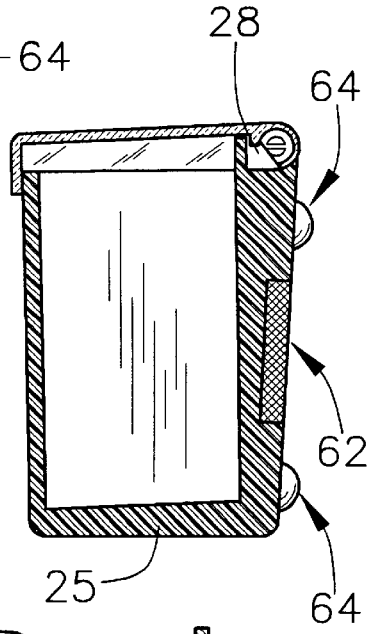
FIG. 3 is a schematic cross-sectional view of the present invention taken along line 3—3 of FIG. 2.
Figure 4:
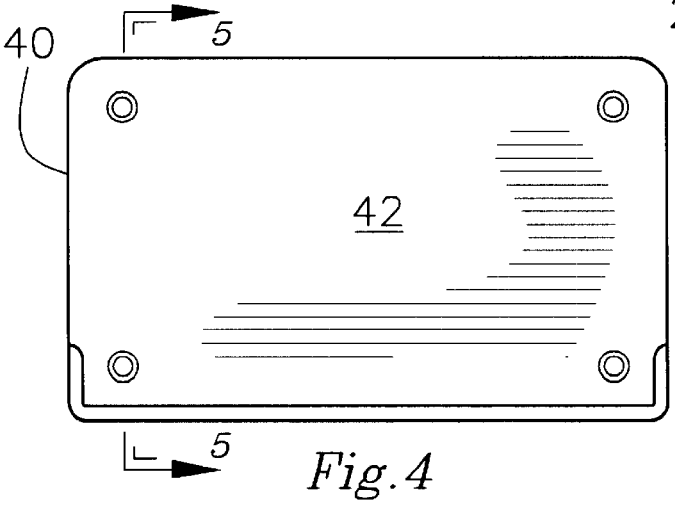
FIG. 4 is a schematic front view of first mount of the present invention.
Figure 5:
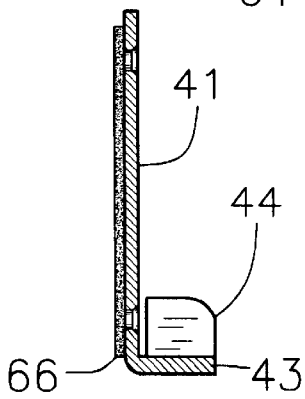
FIG. 5 is a schematic cross-sectional view of the first mount of the present invention taken along line 5—5 of FIG. 4.
Figure 6:
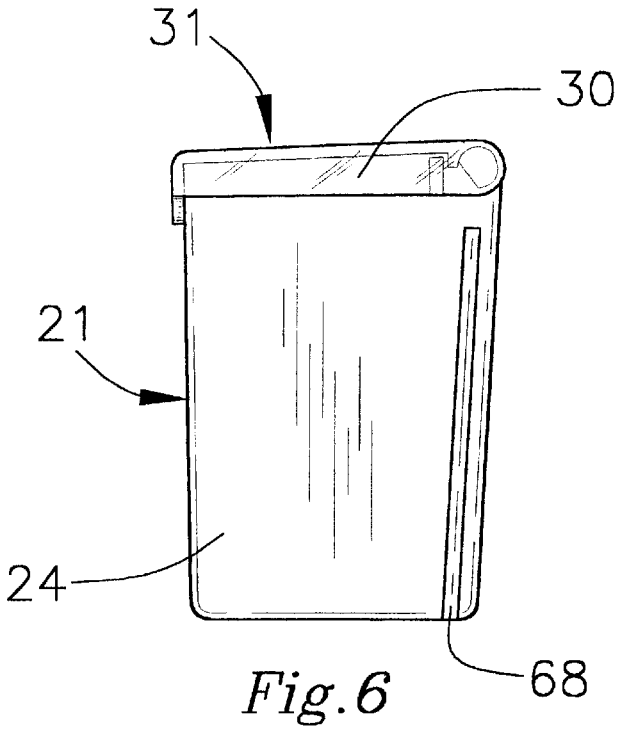
FIG. 6 is a schematic side view of an optional embodiment of the present invention utilizing a second mount structure.
Figure 7:
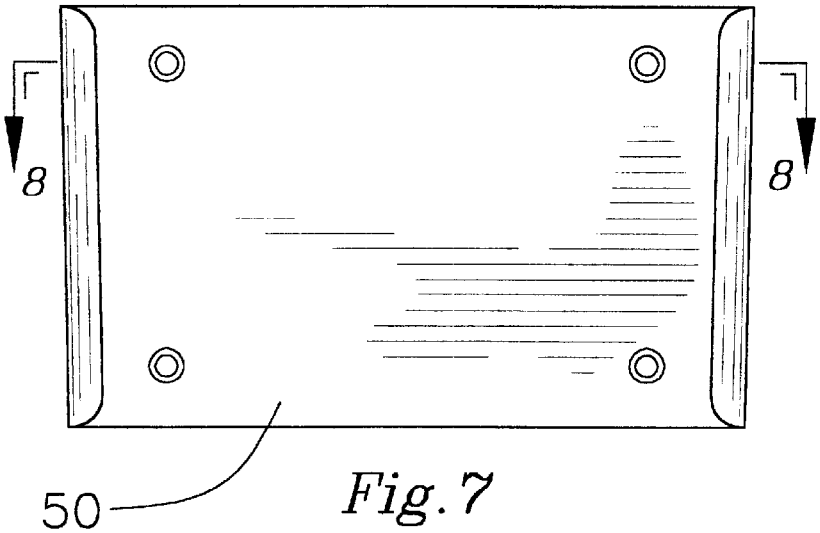
FIG. 7 is a schematic front view of the second mount of the present invention.
Figure 8:
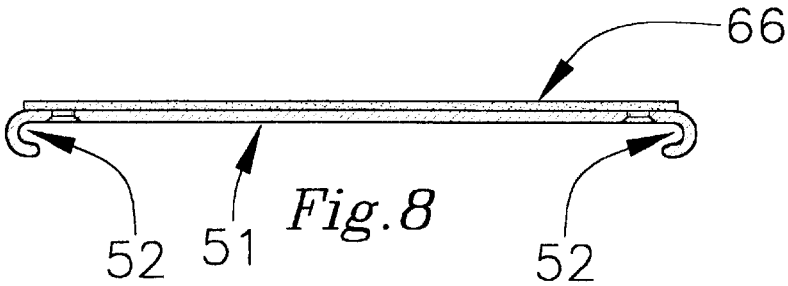
FIG. 8 is a schematic cross-sectional view of the second mount of the present invention taken along line 8—8 of FIG. 7.

With reference now to the drawings, and in particular to FIGS. 1 through 8 thereof, a new article dispensing container embodying the principles and concepts of the present invention and generally designated by the reference numeral 10 will be described.

As best illustrated in FIGS. 1 through 8, the article dispensing container 10 generally comprises a dispensing container for dispensing articles comprising a receptacle 20, a first mount 40, and a second mount 50.

The receptacle 20 is used for holding articles in a manner, which makes dispensing easy. The receptacle 20 comprises a lower portion 21 and an upper lid portion 30.

The lower portion 21 has a cavity for receiving articles. The cavity of the lower portion has an upper opening into the cavity. The lower portion 21 also has a front wall 22, a rear wall 23, and a pair of side walls 24 extending between the front 22 and rear walls 23. The lower portion 21 also has a bottom wall 25 which extends between the front 22, rear 23, and side walls 24. The front 22, rear 23 , and side walls 24 form an upper edge 26 around the upper opening. The front portion of the upper edge 26 on the front wall 22 has a notch 27 which exposes a portion of an article in the recess. The notch 27 and exposed portion of the article facilitate grasping the article in the recess. The rear portion of the upper edge 26 on the rear wall 23 has a channel 28 formed therein. The channel 28 extends along the length of the rear wall 23.

The upper lid portion 30 is pivotally coupled to the lower portion 21 adjacent to the upper edge 26 of the receptacle 21. The upper lid portion 30 has a top wall 31 with a periphery and a depending lip 33 mounted on the periphery of the top wall 31. The depending lip 33 extends about the upper lip of the lower portion 21 when the upper lid portion 30 is in a closed position. The upper lid portion 30 also has a biasing member 34 for biasing the upper lid portion 30 into a closed position. An illustrative example of the biasing member 34 is a torsion spring.

The first mount 40 is used to mount the receptacle 20 to a vertical surface. The first mount 40 includes a first plate 41 with a front surface 42 and a ledge 43, which extends outward from the front surface 42. The bottom wall 25 of the lower portion 21 rests on the ledge 43 extending from the from surface 42. The rear wall 23 of the lower portion 21 has a rear exterior surface with at least one magnet 62 mounted to the exterior surface. The first plate 41 is formed of a metal which is attractive to the magnet 62 mounted on the rear surface of the rear wall 23 of the lower portion 21.

In an embodiment at least two magnets 62 are mounted on the rear exterior surface of the rear wall 23 of the lower portion 21. Also mounted on the rear exterior surface of the lower portion 21 is a plurality of bumpers 64 for positioning between the lower portion 21 and the first plate 41. A pair of spaced ledge walls 44 embrace the lower portion 21 to resist lateral shifting of the receptacle 20 with respect to the first mount 40.

In a further embodiment, the first plate 41 has a plurality of mounting apertures extending through the plate 41 for receiving fasteners.

In another embodiment, the first plate 41 has a rear side with an adhesive member 66.

Optionally, a second mount 50 may be employed to mount the receptacle 20 to a vertical support. The second mount 50 comprises a second plate 51 which has opposite side edged for orienting adjacent to the side edges of the lower portion 21 of the receptacle 20. The side edges of the second plate 51 each have a channel 52 opening substantially parallel to a front surface of the second plate 51. The side walls 24 of the lower portion 21 of the receptacle 20 each have a ridge 68 designed to be removably inserted in the channel 52 of the second plate 50.

In use, one of the two mounts is attached to a vertical support. This attachment is accomplished through the use of the adhesive member, fasteners inserted through the apertures in the mount, or both. The receptacle is then attached to the mount either through use of magnets, or inserting the ridges into the channel of the mount. If the user does not require that the receptacle be readily removable, then the receptacle may be directly affixed to a suitable surface through the use of the adhesive member without interfacing with either of the two mounts. The upper lid portion is moved into the open position while articles are placed inside the receptacle. The upper lid portion is allowed to return to the closed position (by action of the biasing structure) and the receptacle is ready for use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispensing container for dispensing articles therefrom, comprising:

a receptacle for holding articles in a manner for easy dispensing from the receptacle, the receptacle comprising:

a lower portion having a cavity for receiving articles, the cavity of the lower portion having an upper opening into the cavity;

an upper lid portion pivotally coupled to the lower portion adjacent the upper opening of the receptacle;

a first mount for mounting the receptacle to a vertical support, the first mount including a first plate having a front surface;

the receptacle including a rear wall having a rear exterior surface with at least two magnets mounted on thereon, the magnets being spaced from each other toward side walls of the lower portion; and a plurality of bumper members being mounted on the rear exterior surface of the rear wall of the lower portion for positioning between the lower portion and the first plate to facilitate removal of the receptacle as desired by a user;

a ledge extending outwardly from the front surface of the first mount plate for resting a bottom wall of the lower portion on the ledge.

2. The container of claim 1, wherein the first plate comprises a ferromagnetic material.

3. The container of claim 1 additionally comprising a pair of spaced ledge walls extending outwardly from the ledge for embracing the lower portion for resisting lateral shifting of the receptacle with respect to the first mount.

4. The container of claim 1 wherein the first plate has a plurality of mounting apertures extending therethrough for receiving fasteners.

5. The container of claim 1 wherein the lower portion has a front wall, a rear wall, a pair of spaced side walls extending between the front and rear walls, and a bottom wall extending between the front, rear and side walls, the front, rear, and side walls forming an upper edge about the upper opening.

6. The container of claim 5 wherein a front portion of the upper edge on the front wall has a notch therein for exposing a portion of an article in the recess for facilitating grasping of an article in the recess.

7. The container of claim 5 wherein a rear portion of the upper edge on the rear wall has a channel formed therein and extending along a length of the rear portion, a portion of the upper lid portion extending into the channel.

8. The container of claim 5 wherein the upper lid portion has a top wall with a periphery, and the upper lid portion has a depending lip mounted on the periphery of the top wall, the depending lip extending about the upper edge of the lower portion when the upper lid portion is in a closed portion.

9. The container of claim 1 additionally comprising a biasing means for biasing the upper lid portion into a closed position with respect to the lower portion.

10. A dispensing container for dispensing articles therefrom, comprising:

a receptacle for holding articles in a manner for easy dispensing from the receptacle, the receptacle comprising:

a lower portion having a cavity for receiving articles, the cavity of the lower portion having an upper opening into the cavity;

an upper lid portion pivotally coupled to the lower portion adjacent the upper opening of the receptacle;

a first mount for mounting the receptacle to a vertical support, the first mount including a first plate having a front surface;

the receptacle including a rear wall having a rear exterior surface with at least two magnets mounted on thereon, the magnets being spaced from each other toward side walls of the lower portion; and a plurality of bumper members being mounted on the rear exterior surface of the rear wall of the lower portion for positioning between the lower portion and the first plate to facilitate removal of the receptacle as desired by a user;

wherein the first plate has a rear side with an adhesive member thereon.

11. A dispensing container for dispensing articles therefrom, comprising a receptacle for holding articles in a manner for easy dispensing from the receptacle, the receptacle comprising:

a lower portion having a cavity for receiving articles, the cavity of the lower portion having an upper opening into the cavity;

an upper lid portion pivotally coupled to the lower portion adjacent the upper opening of the receptacle;

a first mount for mounting the receptacle to a vertical support, the first mount including a first plate having a front surface;

the receptacle including a rear wall having a rear exterior surface with at least two magnets mounted on thereon, the magnets being spaced from each other toward side walls of the lower portion;

a plurality of bumper members being mounted on the rear exterior surface of the rear wall of the lower portion for positioning between the lower portion and the first plate to facilitate removal of the receptacle as desired by a user; and a second mount for mounting the receptacle to a vertical support, the second mount comprising a second plate having opposite side edges for orienting adjacent to side edges of the lower portion of the receptacle, the side edges of the second plate each having a channel opening substantially parallel to a front surface of the second plate, each of the side walls of the lower portion of the receptacle having a ridge adapted for removable insertion in the channel of the second plate.

* * * * *